US007628186B2

(12) United States Patent
Blum

(10) Patent No.: US 7,628,186 B2
(45) Date of Patent: Dec. 8, 2009

(54) PORTABLE WORKBENCH

(76) Inventor: Gary Joseph Blum, 212 Pearl St., Walnut, IA (US) 51577

( * ) Notice: Subject to any disclaimer, the term of this patent is extended or adjusted under 35 U.S.C. 154(b) by 179 days.

(21) Appl. No.: 11/696,214

(22) Filed: Apr. 4, 2007

(65) Prior Publication Data

US 2008/0245441 A1 Oct. 9, 2008

(51) Int. Cl.
*B25H 1/00* (2006.01)
*A47B 3/00* (2006.01)

(52) U.S. Cl. ..... 144/286.1; 144/286.5; 108/28; 108/115; 248/188; 269/289 R

(58) Field of Classification Search ..... 144/285, 144/286.1, 286.5; 108/115, 118, 159.12, 108/28; 248/188; 269/289 R; 83/471, 477
See application file for complete search history.

(56) References Cited

U.S. PATENT DOCUMENTS 3,944,203 A * 3/1976 Brekelbaum ..... 269/296
5,067,535 A * 11/1991 Wolff ..... 144/286.1
5,135,036 A * 8/1992 Caron ..... 144/286.5
5,161,590 A * 11/1992 Otto ..... 144/286.5
5,862,842 A * 1/1999 You ..... 144/308
6,823,907 B2 * 11/2004 Cheng ..... 144/286.1
7,044,178 B1 * 5/2006 Campbell ..... 144/285
7,055,563 B2 * 6/2006 Logan ..... 144/286.5

FOREIGN PATENT DOCUMENTS

EP 0266172 * 5/1988

* cited by examiner

*Primary Examiner*—Shelley Self
(74) *Attorney, Agent, or Firm*—McKee, Voorhees & Sease, P.L.C.

(57) ABSTRACT

A portable workbench is provided for holding a work piece, and includes a bench top, foldable legs, and a plurality of horizontal and vertical holes adapted to receive a pipe clamp for clamping the work piece to the bench top. The bench top is a torsion box with an internal grid so that the workbench is lightweight, yet strong and stable. The legs include two-piece crossbraces which are quickly and easily connected and disconnected via male and female ends and a securing pin.

26 Claims, 11 Drawing Sheets

PORTABLE WORKBENCH

FIELD OF THE INVENTION

This invention relates to portable workbenches used to secure a work piece to be worked upon. The workbench can be used in industrial, commercial, and residential applications, and is particularly adapted for use in woodworking.

BACKGROUND OF THE INVENTION

Workbenches of various designs have been known for many years. Portable workbenches face a paradox, in that a workbench generally is heavy, strong and unyielding to the forces and actions of a person using the workbench, while portability implies lightweight and compact so as to be easily moved by one person. Also, most stationary workbenches include some sort of vice, which is mounted to the bench for holding a workpiece. Vices are usually heavy, since they are normally made of iron. The use of such a vice on a portable workbench thus makes the bench heavy and bulky. If a lightweight vice is used, its strength and clamping capacity are detrimentally affected.

The top work surface of a workbench is often critical for precision work on a piece. In stationary benches, such as woodworker's bench, the top may be 4-5 inches thick, to provide weight, strength and stiffness necessary for various woodworking tasks and projects. This asset for a stationary workbench becomes a problem for a portable workbench.

The legs of a portable workbench also create problems. Lightweight legs enhance portability but reduce stability. The legs must also be foldable, so that the workbench is compact for portability.

Therefore, a primary objective of the present invention is the provision of an improved portable workbench.

Another objective of the present invention is the provision of a portable workbench which is strong and stable, yet lightweight.

A further objective of the present invention is the provision of a portable workbench that is able to securely clamp a work piece.

Another objective of the present invention is the provision of a portable workbench having a bench top which maintains flatness, and is non-twisting.

Still another objective of the present invention is the provision of a portable workbench having clamping versatility.

Yet another objective of the present invention is the provision of a portable workbench which can clamp a work piece to the top surface, sides, or ends of the bench.

Still another objective of the present invention is the provision of modular workbenches which can be interconnected to increase the work area.

Another objective of the present invention is the provision of a portable workbench having legs which can be quickly and easily folded between a storage position and a use position.

A further objective of the present invention is the provision of a portable workbench having legs which fold into a recess in the bottom of the bench top.

Another objective of the present invention is the provision of an improved workbench with a bench top constructed as a torsion box.

Another objective of the present invention is the provision of an improved workbench having a bench top with horizontal and vertical holes for receiving pipe or bar clamps for securing work pieces to the bench top.

A further objective of the present invention is the provision of an improved portable workbench having a vice block and bench dogs for clamping a work piece for planing.

Still another objective of the present invention is the provision of a workbench having a bench top with a storage compartment built therein.

Another objective of the present invention is the provision of an improved workbench which is economical to manufacture and durable in use.

These and other objectives become apparent from the follow description of the invention.

BRIEF SUMMARY OF THE INVENTION

A portable workbench is provided for holding a work piece to be worked upon. The workbench includes a bench top having a plurality of horizontal holes and vertical holes extending through the bench top and adapted to selectively receive one or more pipe clamps for clamping a work piece to the bench top. Legs are pivotally mounted to the bench top for movement between a folded storage position adjacent the bench top and an unfolded use position extending downwardly from the bench top. The bench top is constructed as a torsion box, so as to be lightweight, yet strong and rigid. The legs include crossbraces to provide stability for the workbench, and adjustable levelers which provide stability for the workbench on uneven surfaces. A storage compartment is provided in the bench top for holding bench dogs, tools, hold downs, and other accessories.

DETAILED DESCRIPTION OF THE PREFERRED EMBODIMENT

Figure 1:
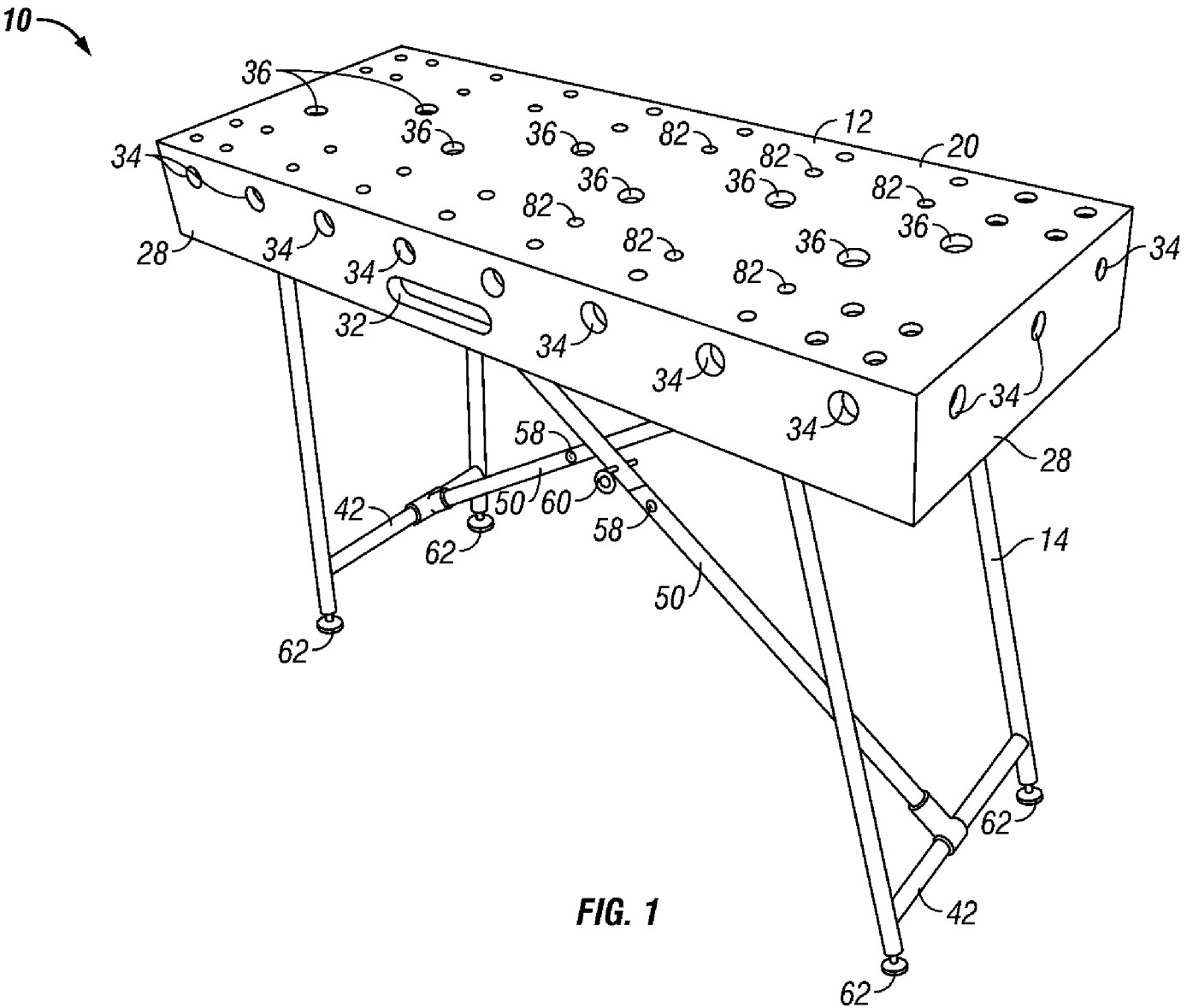
FIG. 1 is a perspective view of the portable workbench of the present invention.

The improved portable workbench of the present invention is generally designated by the reference numeral 10 in the drawings. The primary components of the workbench 10 are the bench top 12 and the folding legs 14.

The bench top 12 is constructed as a torsion box, having opposite sides 16, opposite ends 18, an upper skin 20, a lower skin 22 and an internal grid formed by longitudinal members 24 and lateral members 26. The torsion box components are preferably glued together, but may also be secured to one another using screws. This torsion box construction of the bench top 12 provides strength and rigidity, yet maintaining a light weight for easy portability of the workbench 10.

A rigid apron or skirt 28 extends around the perimeter of the bench top 12. The top edge of the apron 28 is flush with the upper surface of the upper skin 20. The lower edge of the apron 28 extends below the lower skin 22 so as to form a recess 30 in the bottom of the bench top 12. One or more slots 32 may be provided in the apron 28 so as to form a hand hold for carrying the workbench 10.

The bench top 12 has a series of horizontal holes 34 extending therethrough, and a series of vertical holes 36 extending therethrough. The horizontal holes 34 extend through each of the longitudinal and lateral grid members 24, 26. These holes 34, 36 are adapted to receive a pipe or bar clamp, as shown in FIGS. 6-10. The use of pipe clamps with the workbench 10 to secure work pieces to the bench top 12 will be described in more detail below.

Figure 2:
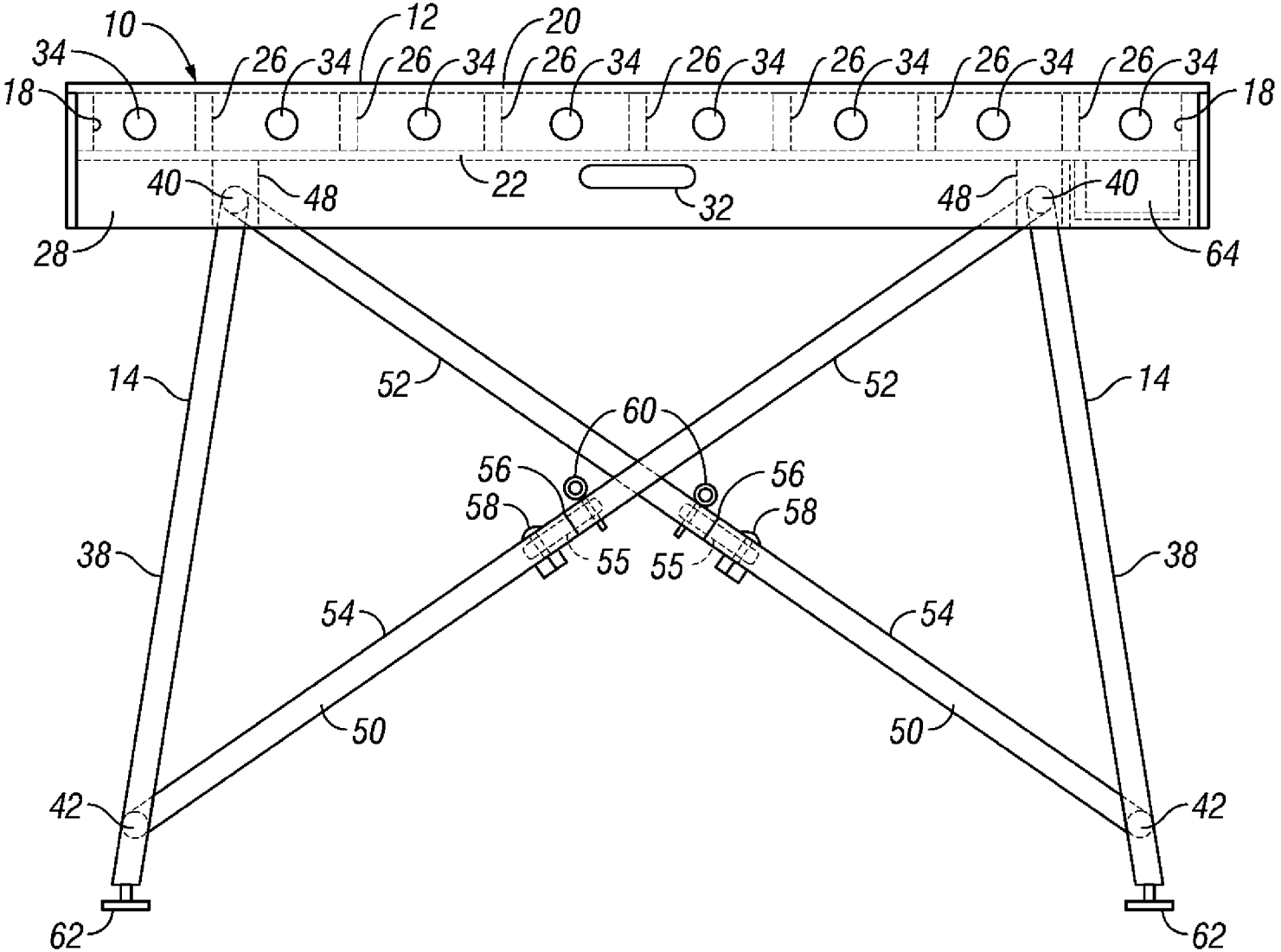
FIG. 2 is a side elevation view of the workbench.

Each of the legs 14 of the workbench 10 generally includes a rectangular member 38 with an upper axle 40 and a lower cross piece 42. The opposite ends of each axle 40 are pivotally mounted in sockets 48 secured on the inside of the apron 28 within the recess 30 on the bottom of the bench top 12. As best seen in FIG. 2, the sockets 48 at opposite ends of the bench top 12 are offset so as to allow folding of the legs upon one another within the recess 30. For example, as seen in FIG. 2, the left socket 48 is positioned adjacent the lower skin 22 of the bench top, while the right socket 48 is spaced downwardly from the lower skin 22 near the bottom edge of the apron 28. Thus, the left leg 14 can be folded to the storage position first, and then the right leg folded on top of the left leg, as described in more detail below.

Figure 5:
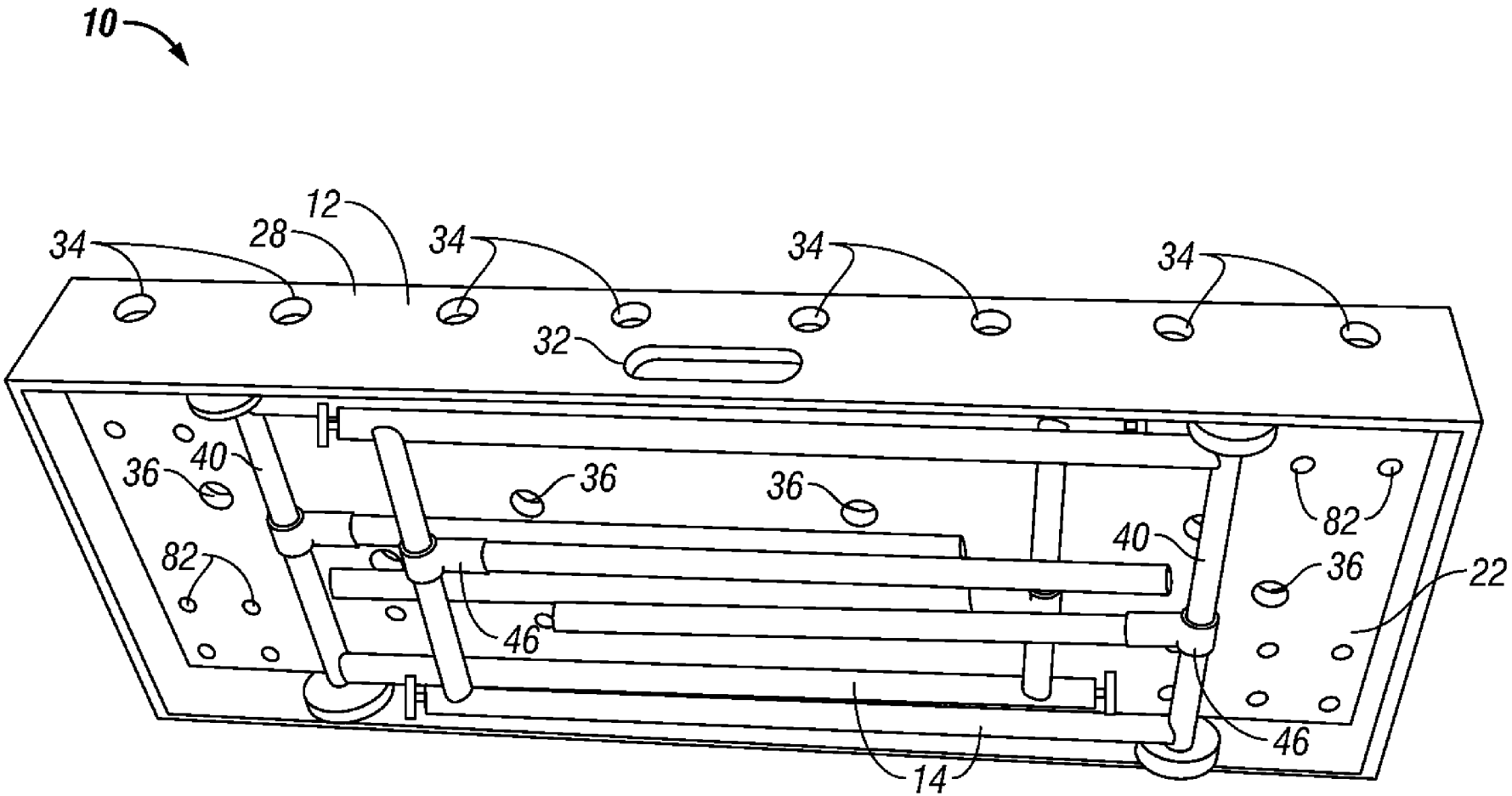
FIG. 5 is a bottom perspective view of the workbench showing the legs in the folded, storage position.
Figure 6:
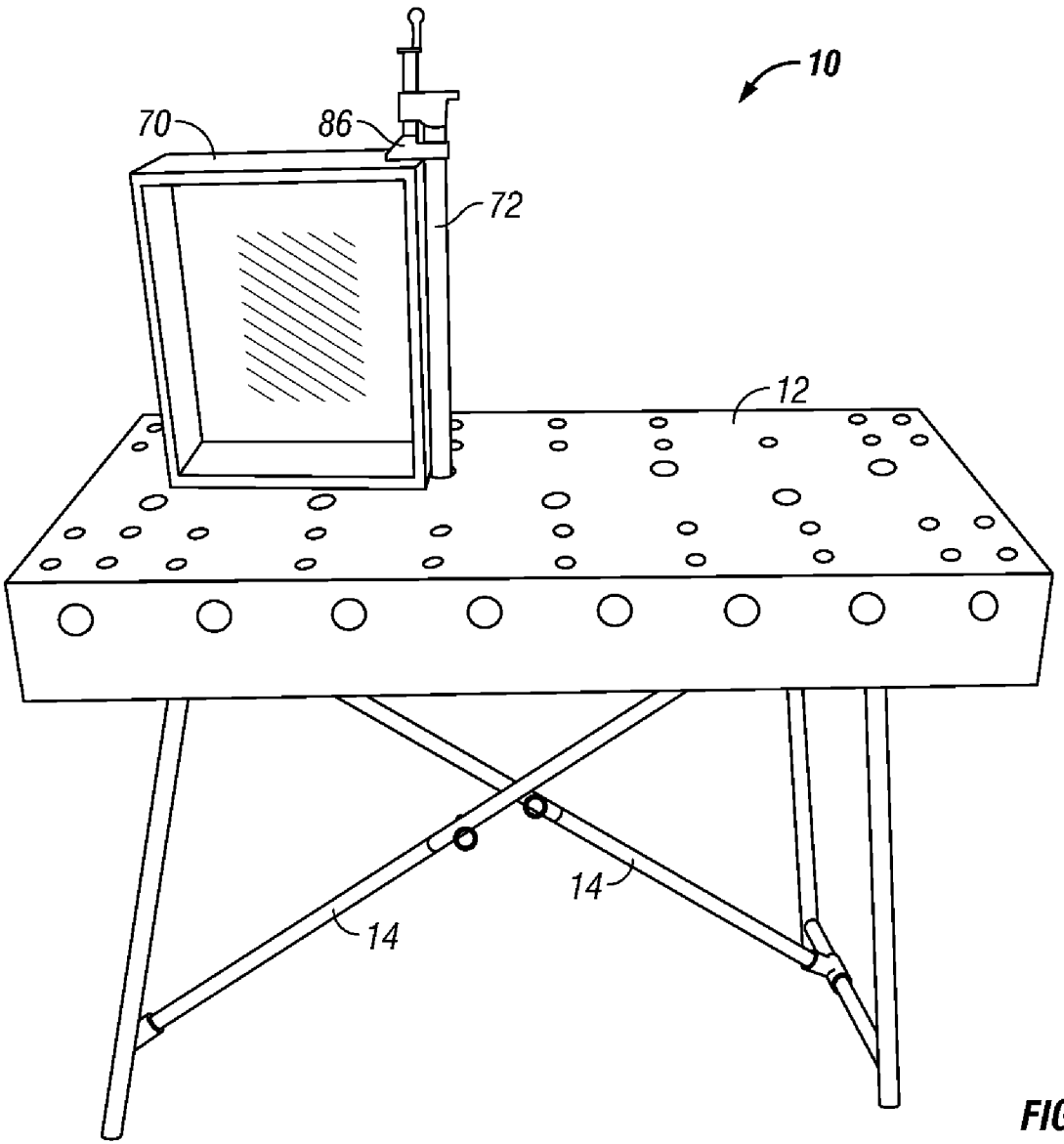
FIG. 6 is a view of the workbench showing a work piece clamped in a vertical direction by a pipe clamp.

A pair of crossbraces 50 are provided for the legs 14. Each crossbrace 50 includes an upper end connected to one of the axles 40 and a lower end connected to the cross piece 42 of the opposite leg. The upper and lower ends of the crossbraces 50 are connected to the axles 40 and cross pieces 42 by a T-fitting 46 which allow the ends of the crossbraces 50 to pivot about the axles 40 and cross pieces 42. Preferably, each crossbrace 50 is formed with an upper arm 52 and a lower arm 54. One of the upper and lower arms 52, 54 includes a reduced diameter male end which is received in the larger diameter female end of the opposite arm, so as to define a male/female connection point 56 between the upper and lower arms 52, 54. For example, the reduced diameter end may be formed by a smaller diameter pipe 55 having one end secured by bolts 54, adhesive, other fasteners, or welding to one of the arms 52, 54. A removable pin 60 allows the joint 56 to be quickly and easily assembled and disassembled for movement of the legs 14 between the folded storage position shown in FIG. 5 and the unfolded use position shown in FIG. 2.

One example of a commercially available T-fitting 46 is sold under the trademark QUIXX-SMART, and includes a stop element to control the degree of rotation of the upper and lower arms 42, 44 when they are disconnected.

The legs 14 also include adjustable levelers 62 so as to provide stability for the workbench 10, when the bench is set upon an uneven surface or ground. The levelers 62 may be in the form of a foot threadably received in the lower end of the legs which can be threaded and unthreaded to provide the desired leg length.

Clips (not shown) may be provided on the bottom of the skin 22 for holding the legs 14 in the folded, storage position.

Preferably, each of the legs 14 extend downwardly in an angle of approximately 100° from the bench top 12, in opposite directions from one another, as best seen in FIG. 2. This angled orientation of the legs allows the workbench 10 to withstand the pressures of planing and sanding, without the workbench sliding along the floor. Also, since the axles 40 of the legs 14 are spaced inwardly from the opposite ends 18 of the bench top 12, the lower end of the legs 14 do not protrude past the ends 18 of the top 12, as seen in FIG. 2.

Figure 3:
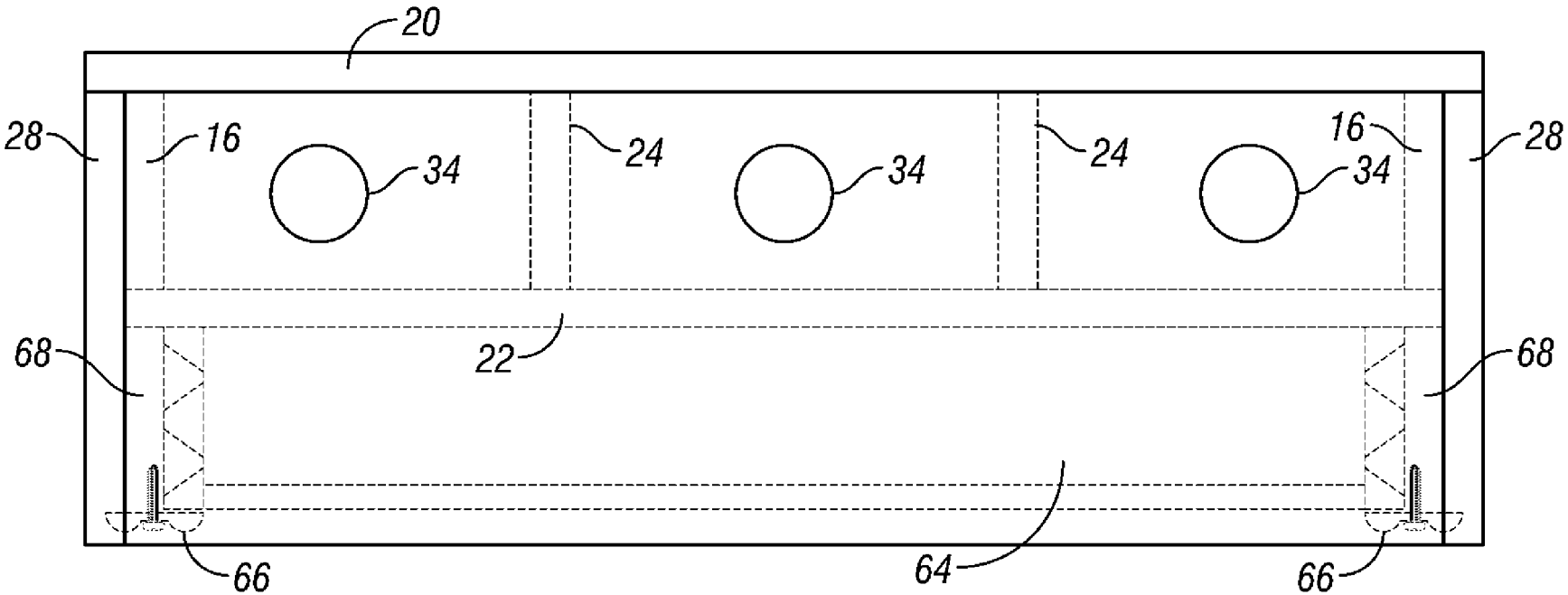
FIG. 3 is an end elevation view of the bench top of the workbench.
Figure 4:
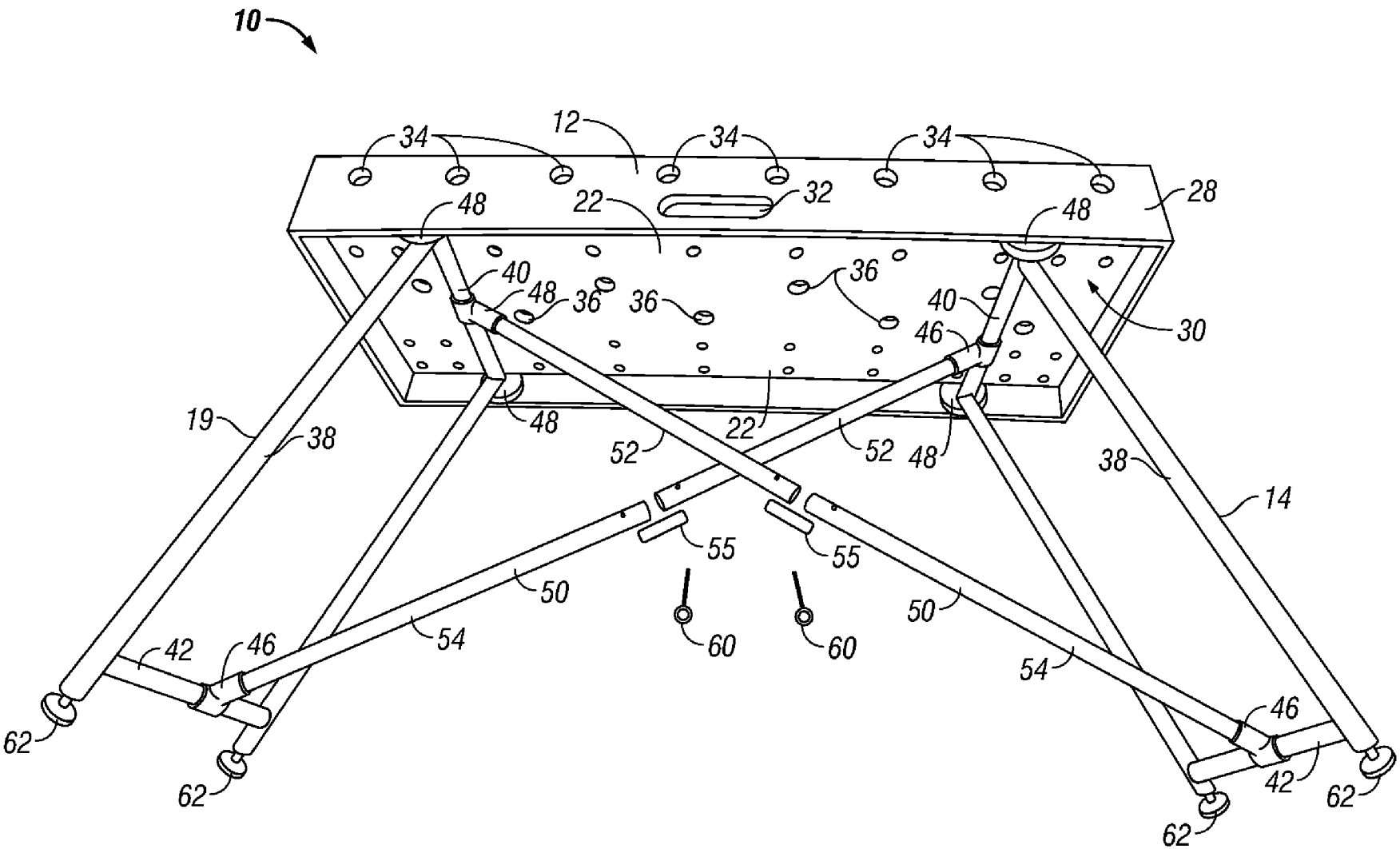
FIG. 4 is a bottom perspective view of the workbench showing the disassembled crossbraces of the workbench legs, without a storage bin.

The sockets 48 are spaced inwardly from the opposite ends of the bench top 12, as best seen in FIG. 2, thereby providing space at one or both ends for a storage bin 64. Preferably, the bin 64 has an open top, with the top edge of the bin engaging the bottom surface of the lower skin 22 of the bench top 12. The bin 64 is removably retained by a plurality of rotatable turn buttons 66 mounted to a cleat 68 on the inside of the apron 28, as best seen in FIG. 3.

FIGS. 6-10 show various work pieces clamped to the bench top 12. More particularly, in FIG. 6, a work piece 70 in the form of a box or drawer is secured in position on the top of the bench top 12 using a single pipe clamp 72 extending vertically through one of the holes 36 in the bench top 12. The tail piece 85 of the pipe clamp 72 is removed from the pipe, which is then inserted through the selected hole 36, and the tail piece 85 is then placed back on the pipe so that the work piece 70 can be secured in the desired position on the bench top 12 by tightening the clamp head 86.

Figure 7:
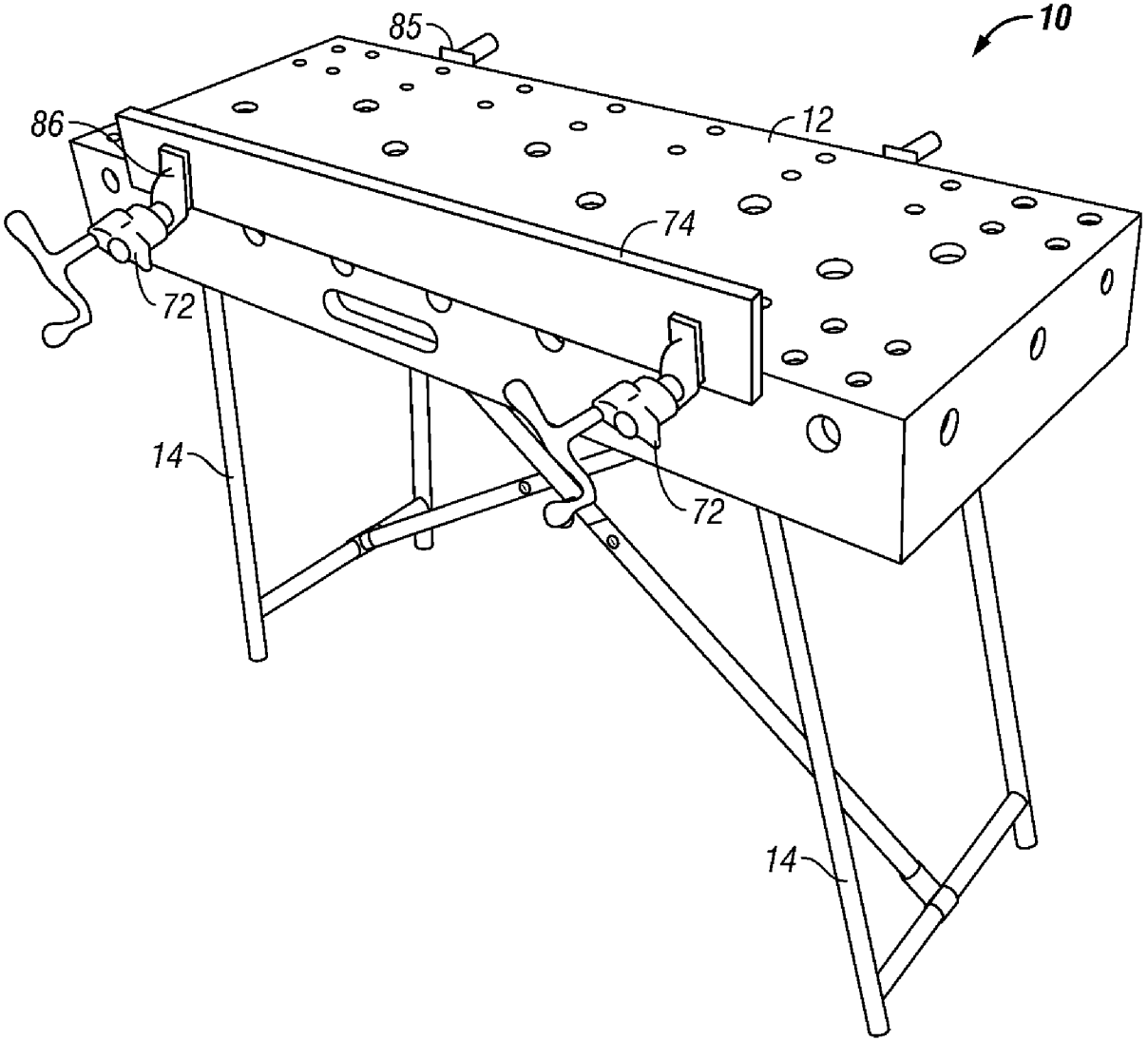
FIG. 7 is a view of the workbench showing a work piece clamped in a horizontal direction by a pair of pipe clamps.
Figure 8:
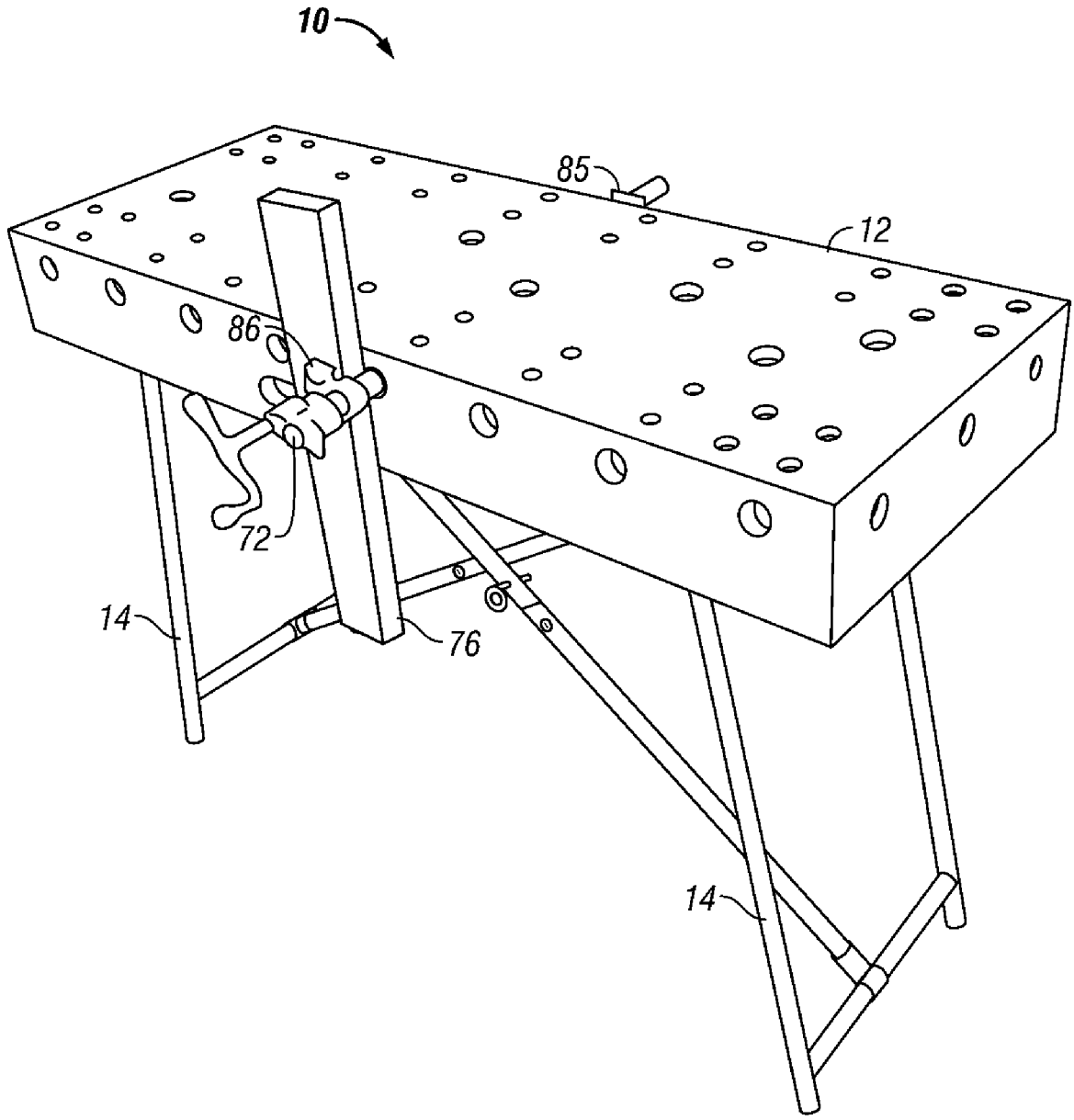
FIG. 8 is a view of the workbench with another work piece clamped in a horizontal position by a pipe clamp.

FIG. 7 shows a board work piece 74 clamped to one side 16 of the bench top 20 using a pair of pipe clamps 72. The upper edge of the board 74 resides above the upper surface of the bench top 12 for planing or other work. FIG. 8 shows a board 76 clamped to a side 16 of the bench top 12 by a single pipe clamp 72. In FIG. 8, the pipe clamp 72 is on the side of the board, whereas in FIG. 7, the pipe clamps 72 are beneath the board 74.

Figure 9:
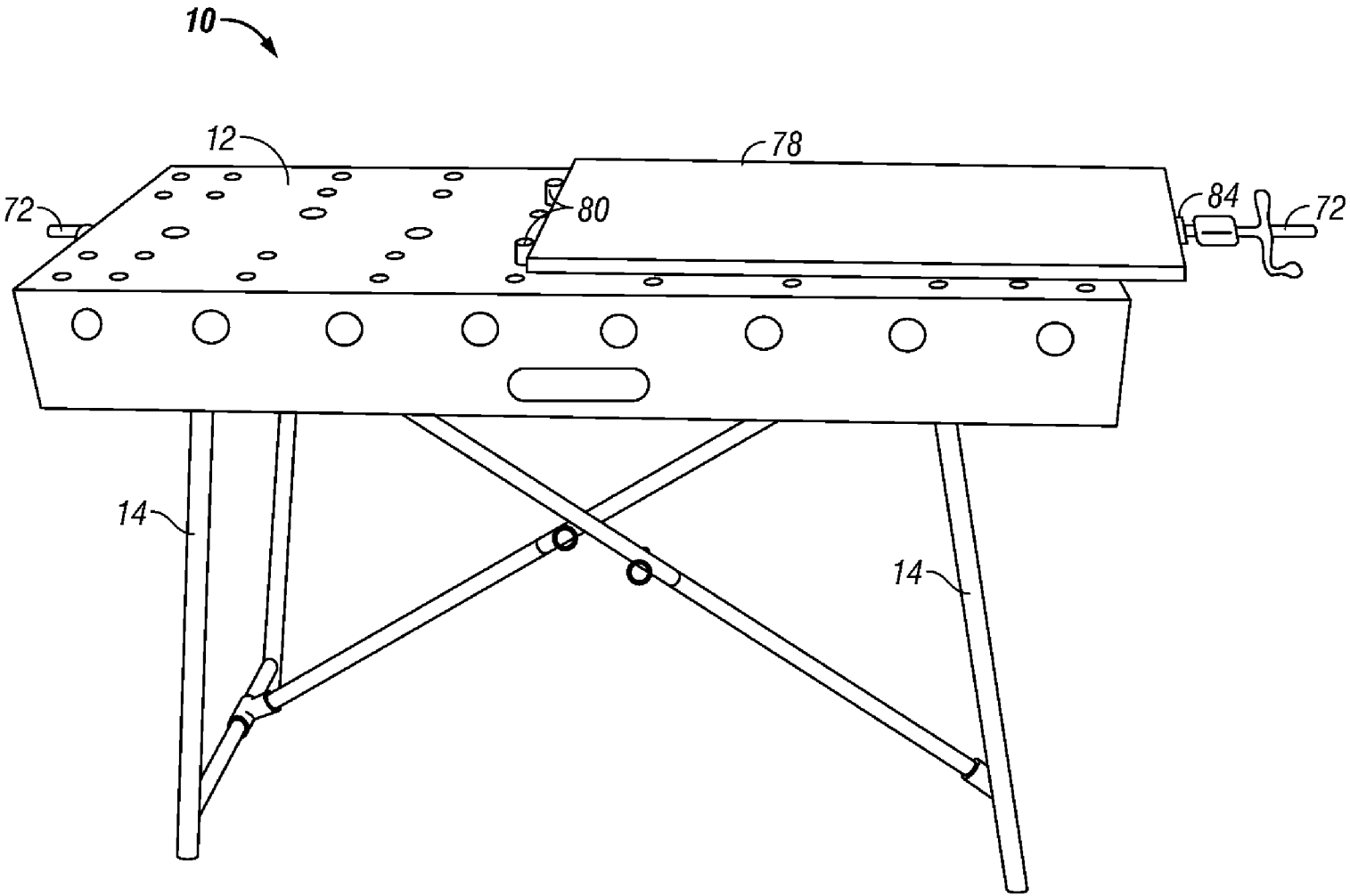
FIG. 9 is a view of the workbench showing another work piece clamped between bench dogs and a vice block on a pipe clamp.

FIG. 9 shows a board 78 secured to the top of the bench top 12 using a pipe clamp 72 and one or more bench dogs 80. The bench dogs 80 extend through smaller diameter holes 82 in the upper and lower skins 20, 22 of the bench top. The bench dogs 80 are in the form of a dowel with an O-ring to maintain the dog 80 at a desired height in the holes 82. Thus, as seen in FIG. 9, the upper surface of the board 78 is free of obstructions to permit easy sanding or planing across the entire upper surface of the board. A vice block 84 may be provided on the pipe clamps 72 in addition to the clamp head 86.

Figure 10:
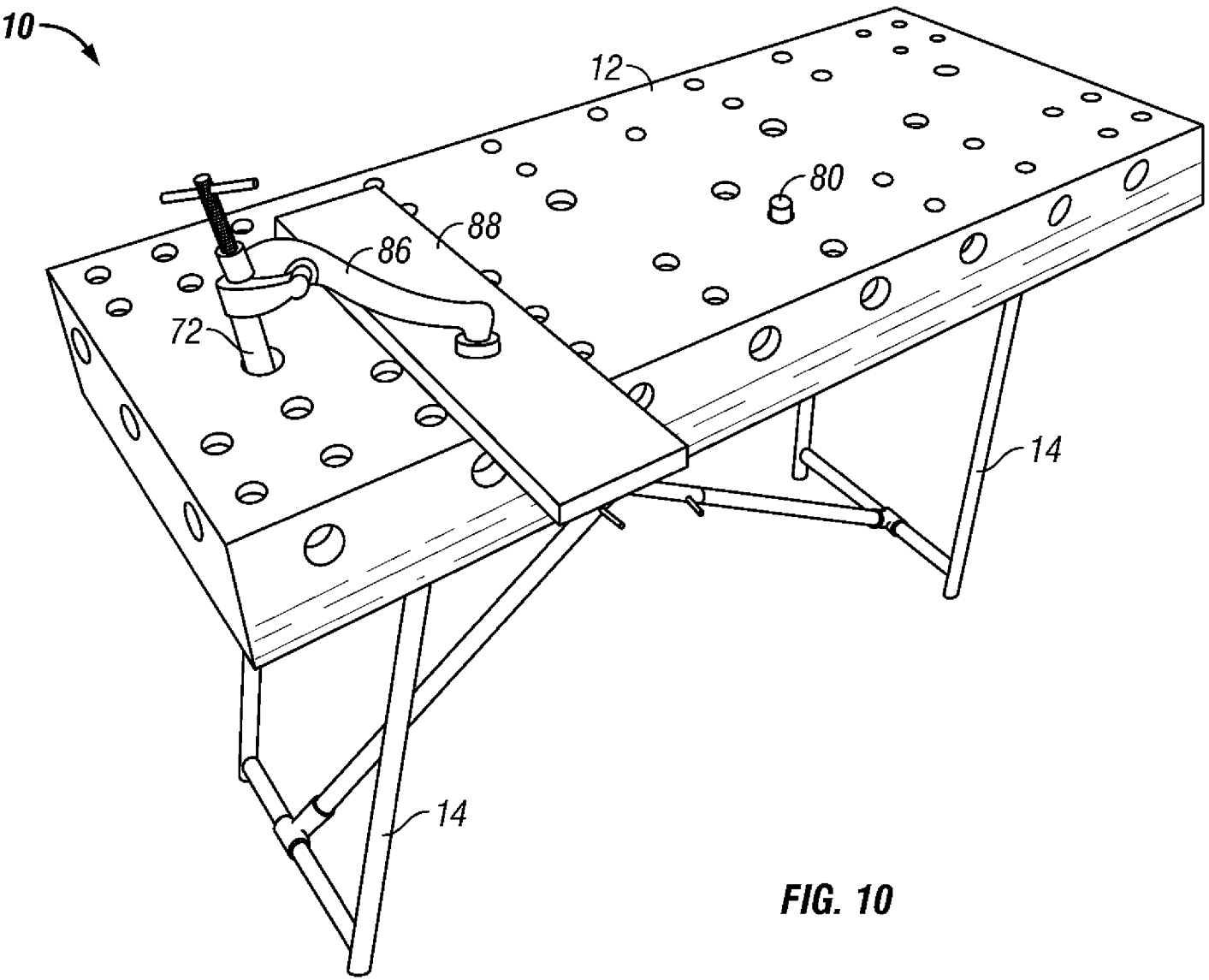
FIG. 10 is a view of the workbench with another work piece clamped in a vertical direction to the top of the workbench.

FIG. 10 shows a board 88 clamped to the top of the bench top 12 using a vertical pipe clamp 72 extending through one of the vertical holes 36, with the end of the board extending beyond the side of the bench top 12 for sawing, drilling, or other work.

Figure 11:
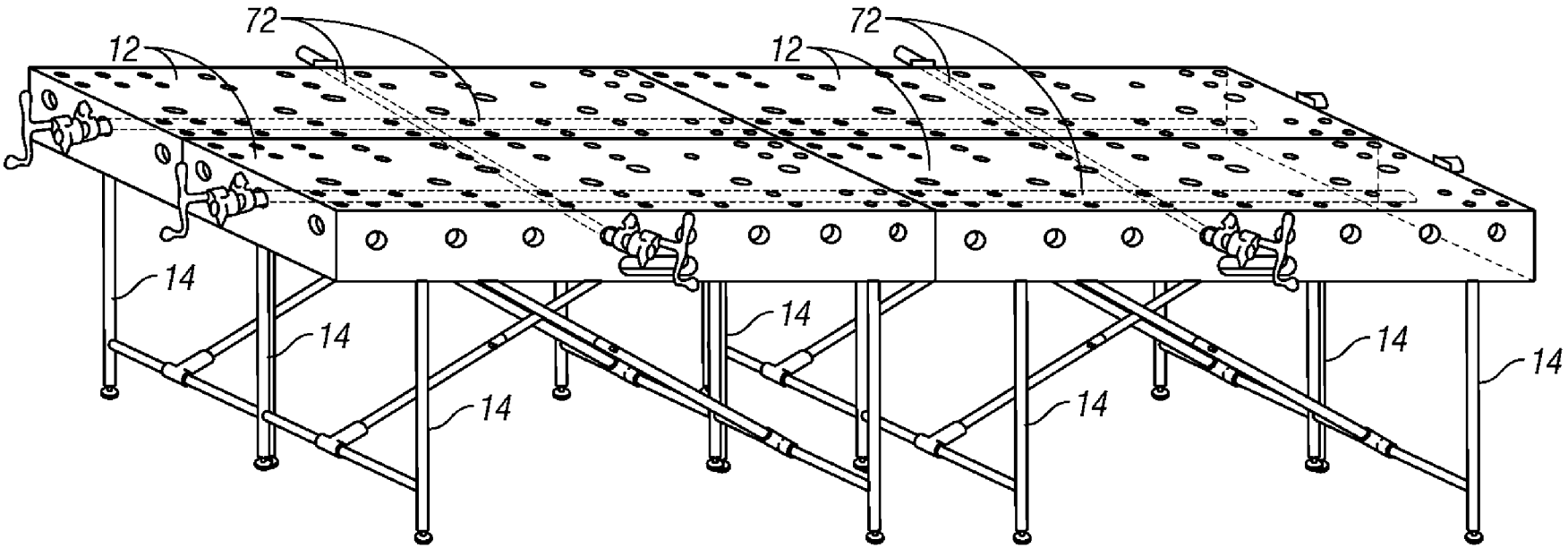
FIG. 11 is a perspective view of workbench modules connected together by pipe clamps to form an enlarged work area.

Multiple workbenches 10 can be arranged side-by-side and/or end-to-end, and clamped together using elongated pipe clamps extending through selected horizontal holes 34, thereby creating an enlarged work surface formed by the modular workbenches 10, as shown in FIG. 11. Thus, attaching multiple workbenches 10 together provides a portable enlarged work area with increased clamping versatility and capacity.

The invention has been shown and described above with the preferred embodiments, and it is understood that many modifications, substitutions, and additions may be made which are within the intended spirit and scope of the invention. It is understood that other functionally equivalent clamps can also be used with the workbench 10. For example, a bar clamp can be substituted for the pipe clamp. From the foregoing, it can be seen that the present invention accomplishes at least all of its stated objectives.

What is claimed is:

1. A portable workbench for holding a workpiece, comprising:

a torsion box having perimeter walls, upper and lower skins connected to the perimeter walls, and an internal grid secured to the upper and lower skins;

legs pivotally mounted to the torsion box for movement between a folded storage position adjacent the torsion box and an unfolded use position extending downwardly from the torsion box; and a plurality of horizontal holes extending through opposite perimeter walls and through the internal grid and adapted to selectively receive a pipe clamp for clamping a workpiece to the torsion box.

2. The portable workbench of claim 1 further comprising a plurality of vertical holes extending through the upper and lower skins and adapted to receive a pipe clamp for clamping a work piece to the torsion box with a vertical force.

3. The portable workbench of claim 1 wherein the internal grid includes lateral and longitudinal grid members and the horizontal holes extend laterally and longitudinally through the grid members.

4. The portable workbench of claim 1 wherein the perimeter walls include opposite side walls and the horizontal holes extend through the opposite side walls.

5. The portable workbench of claim 1 wherein the perimeter walls include opposite end walls and the horizontal holes extend through the opposite end walls.

6. The portable workbench of claim 1 wherein the perimeter walls include opposite side walls and opposite end walls, and the horizontal holes include a first set extending through the side walls and a second set extending through the end walls.

7. The portable workbench of claim 1 wherein the perimeter walls form a bottom recess for receiving the legs when folded to the storage position.

8. The portable workbench of claim 7 further comprising a storage box mounted in the recess.

9. The portable workbench of claim 1 wherein the legs include first and second rectangular members each having an upper axle pivotally mounted to the lower skin and a lower cross piece.

10. The portable workbench of claim 9 further comprising first and second crossbraces having an upper end connected to the axles of the first and second rectangular members, respectively, and a lower end connected to the second and first cross pieces, respectively.

11. The portable workbench of claim 10 wherein the upper and lower ends of the crossbraces are pivotally connected to the respective axles and cross pieces with a T-fitting.

12. The portable workbench of claim 10 wherein each crossbrace includes upper and lower arms with male and female connecting ends which are releasably coupled so as to be connected when the legs are in the use position and disconnected when the legs are in the folded position.

13. The portable workbench of claim 1 wherein the legs include adjustable levelers.

14. A portable workbench for holding a workpiece, comprising:

a torsion box having perimeter walls, upper and lower skins extending between the perimeter walls, and an internal grid secured to the upper and lower skins;

legs pivotally mounted to the torsion box for movement between a folded storage position adjacent the torsion box and an unfolded use position extending downwardly from the torsion box; and a plurality of vertical holes extending through the upper and lower skins; and a pipe clamp extending through one of the vertical holes for clamping a workpiece to the torsion box with a vertical clamping force.

15. The portable workbench of claim 14 further comprising a plurality of horizontal holes extending through the perimeter wall and through the internal grid and adapted to receive a pipe clamp for clamping a work piece to the torsion box.

16. The portable workbench of claim 15 wherein the perimeter walls include opposite side walls and the horizontal holes extend through the opposite side walls.

17. The portable workbench of claim 15 wherein the perimeter walls include opposite end walls and the horizontal holes extend through the opposite end walls.

18. The portable workbench of claim 15 wherein the perimeter wall includes opposite side walls and opposite end walls, and the horizontal holes include a first set extending through the side walls and a second set extending through the end walls.

19. The portable workbench of claim 14 wherein the internal grid includes lateral and longitudinal grid members and horizontal holes extending laterally and longitudinally through the grid members.

20. The portable workbench of claim 14 wherein the perimeter walls form a bottom recess for receiving the legs when folded to the storage position.

21. The portable workbench of claim 20 further comprising a storage box removably mounted in the recess.

22. The portable workbench of claim 14 wherein the legs include first and second rectangular members each having an upper axle pivotally mounted to the lower skin and a lower cross piece.

23. The portable workbench of claim 22 further comprising first and second crossbraces having an upper end connected to the axles of the first and second rectangular members, respectively, and a lower end connected to the second and first cross pieces, respectively.

24. The portable workbench of claim 22 wherein the upper and lower ends of the crossbraces are pivotally connected to the respective axles and cross pieces with a T-fitting.

25. The portable workbench of claim 22 wherein each crossbrace includes upper and lower arms with male and female connecting ends which are releasably coupled so as to be connected when the legs are in the use position and disconnected when the legs are in the folded position.

26. The portable workbench of claim 14 wherein the legs include adjustable levelers.

* * * * *